United States Patent [19]

Bryson

[11] Patent Number: 4,547,632

[45] Date of Patent: Oct. 15, 1985

[54] DYNAMIC LOUDSPEAKER

[75] Inventor: Michael Bryson, Buchanan, Mich.

[73] Assignee: Electro-Voice, Incorporated, Buchanan, Mich.

[21] Appl. No.: 597,238

[22] Filed: Apr. 4, 1984

[51] Int. Cl.[4] ..... H04R 9/02

[52] U.S. Cl. ..... 179/115.5 VC; 179/115.5 R; 179/119 R

[58] Field of Search ..... 179/115.5 VC, 115.5 R, 179/115.5 DV, 115.5 PC, 117, 119 R

[56] References Cited

U.S. PATENT DOCUMENTS

| | | | |
|---|---|---|---|
| 1,997,051 | 4/1935 | Engholm | 179/115.5 VC |
| 3,258,543 | 6/1966 | Mosier | 179/115.5 R |
| 3,925,626 | 12/1975 | Stallings, Jr. | 179/115.5 ES |
| 4,029,911 | 6/1977 | Albinger | 179/115.5 VC |
| 4,297,537 | 10/1981 | Babb | 179/115.5 VC |

FOREIGN PATENT DOCUMENTS

| | | | |
|---|---|---|---|
| 2150358 | 4/1973 | Fed. Rep. of Germany | 179/115.5 VC |
| 2304238 | 10/1976 | France | 179/115.5 R |
| 55-73196 | 6/1980 | Japan | 179/115.5 R |
| 451984 | 8/1936 | United Kingdom | 179/115.5 R |
| 491384 | 9/1938 | United Kingdom | 179/115.5 R |

*Primary Examiner*—Gene Z. Rubinson
*Assistant Examiner*—Danita R. Byrd
*Attorney, Agent, or Firm*—Burmeister, York, Palmatier, Hamby & Jones

[57] ABSTRACT

An electromagnetic loudspeaker with a magnetic structure provided with a cylindrical gap and a frame supporting a diaphragm, the diaphragm carrying a voice coil suspended in the gap of the magnetic structure, the magnetic structure being provided with a thin coating of plastic such as teflon or nylon confronting the voice coil to prevent abrasion or shorting of the voice coil in the event the voice coil contacts the magnetic structure.

7 Claims, 4 Drawing Figures

DYNAMIC LOUDSPEAKER

The present invention relates generally to loudspeakers, and more particularly to dynamic loudspeakers.

Dynamic loudspeakers are well known in the art. Such loudspeakers employ a magnetic structure with a cylindrical gap, and a permenant magnetic field extends across the gap. A diaphragm is mounted on the magnetic structure, and a voice coil mounted on the diaphragm. The voice coil is translatably disposed within the magnetic gap. By providing electrical signals to the voice coil, the electrical field from the coil interacts with the magnetic field of the gap to cause movement of the voice coil and diaphragm. Such single coil, single cone loudspeakers are analyzed in *Acoustical Engineering* by Harry F. Olsen, D. VanNostrand Company, Inc., Princeton, N.J., 1957, pages 125 through 137.

Loudspeakers of the type described above are limited in their ability to produce loud sounds, particularly at low frequencies. When a loudspeaker is driven with an electrical signal in excess of its capacity, the voice coil of the loudspeaker may simply melt, or the material of the form upon which the voice coil is mounted may char and become destroyed. Accordingly, engineers attempt to increase the power handling capacity of such loudspeakers by judicious selection of materials for the form for the voice coil and by winding the coil with heavy wire capable of handling the contemplated power. Efforts have also been made to remove the heat from the voice coil structure by use of thermal conducting coil forms and the like. Nevertheless, there has remained an upper limit to the power handling capabilities of such dynamic loudspeakers.

The present inventor has found that one of the factors tending to destroy the voice coil of such dynamic loudspeakers when subjected to large signal currents is the likelihood that the voice coil will be driven into abutment with the confronting surface of the cylindrical gap. Virtually all such dynamic loudspeakers wind the voice coil on the exterior of the coil form, and the inventor has found that the momentary rubbing of the voice coil against the confronting surface of the magnetic structure both wears the insulation from the voice coil and shorts the voice coil turns with respect to each other. Accordingly, the voice coil resistance is decreased by the short against the magnetic structure, thus resulting in an increase in current in the voice coil and a further likelihood of voice coil failure. It is accordingly an object of the present invention to provide a loudspeaker structure in which shorting of the voice coil against the magnetic structure will be avoided.

One way to avoid contact between the voice coil and the magnetic structure is to increase the width of the cylindrical magnetic gap. It is however desirable to maintain the width of the magnetic gap as small as possible in order to maximize the magnetic field to which the voice coil is subjected, as the magnetic field is decreased with increased gap width. Hence, to maintain the same magnetic field requires a much greater magnetic structure and a much more costly structure. Hence it is an object of the present invention to reduce the likelihood of shorting of the voice coil against the magnetic structure without increasing the width of the cylindrical magnetic gap.

U.S. Pat. No. 4,297,537 to Babb entitled DYNAMIC LOUDSPEAKER provides bumpers to limit the excursion of the voice coil in the magnetic gap. The bumpers of Babb however function only to limit transverse movement of the voice coil, and it is the object of the present invention to avoid the adverse consequences of lateral movement of the voice coil.

Plastic has been used in connection with the magnetic structure of electromechanical transducers in order to hold the parts of the transducer together. U.S. Pat. No. 3,258,543 of H. F. Mosier, Jr. entitled DYNAMIC MICROPHONE, and U.S. Pat. No. 4,029,911 of Walter Albinger entitled ELECTRO-ACOUSTIC TRANSDUCER AND METHOD OF MANUFACTURING SUCH A TRANSDUCER are examples of such constructions. However, the surface of the magnetic gap is maintained free of plastic in these constructions. Even though plastic is a nonpolar material and relatively inert to the passage of magnetic flux, the presence of a layer of plastic requires a wider magnetic gap, since the plastic layer itself is a part of the magnetic gap. The present inventor has found that a thin layer of certain plastics on the cylindrical surface of the face plate of a dynamic loudspeaker can be utilized without materially increasing the width of the gap, hence minimizing the decrease in the magnetic field across the gap resulting from the addition of a plastic coating.

The plastic must be electrically insulating in order to avoid shorting of turns when the voice coil abuts the plastic layer on the cylindrical surface of the gap of the magnetic structure. Also, it is desirable that the plastic be hard in order to withstand abrasion. A hardness of at least 3H determined by the American Society of Testing Material Specification D 3363-74 is required. In addition, the plastic layer must withstand relatively high temperatures without deterioration, since the magnetic structure will operate under high powered conditions at relatively high temperatures, that is, of the order of 200° F.

The present inventor has found that two plastics are particularly suitable for coating the cylindrical surface of the face plate of the loudspeaker, namely, Teflon and nylon. Of the two, Teflon is preferable due to its self lubricating properties. The Teflon coating reduces abrasion caused by the contact of the voice coil against the face plate, prevents deterioration of the voice coil insulation, avoids shorting adjacent turns of the voice coil as a result of contact of the voice coil against the face plate of the loudspeaker, and greatly extends the life of the loudspeaker under high powered conditions.

Further objects of the present invention will become apparent from a further consideration of this specification, particularly when viewed in the light of the drawings, in which.

Figure 2:
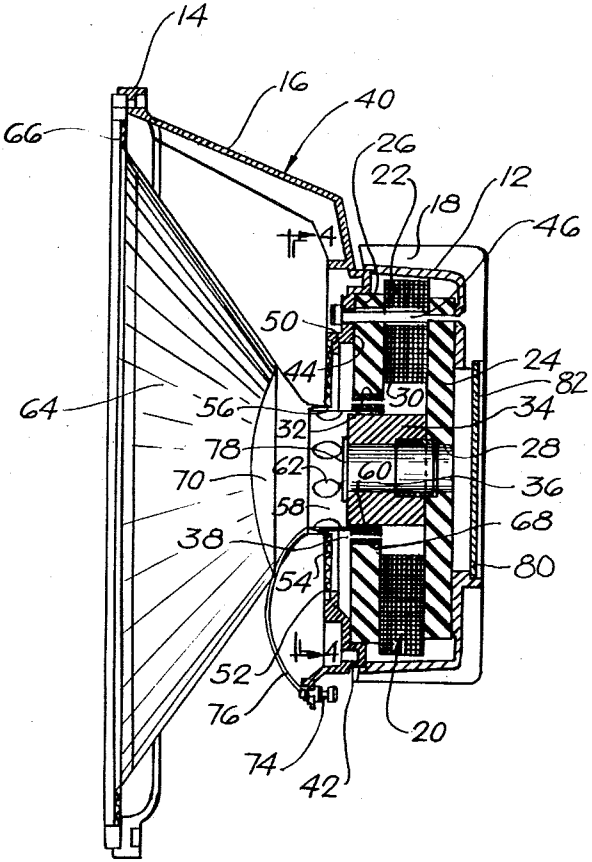
FIG. 2 is a sectional view taken along the line 2—2 of FIG. 1.
Figure 1:
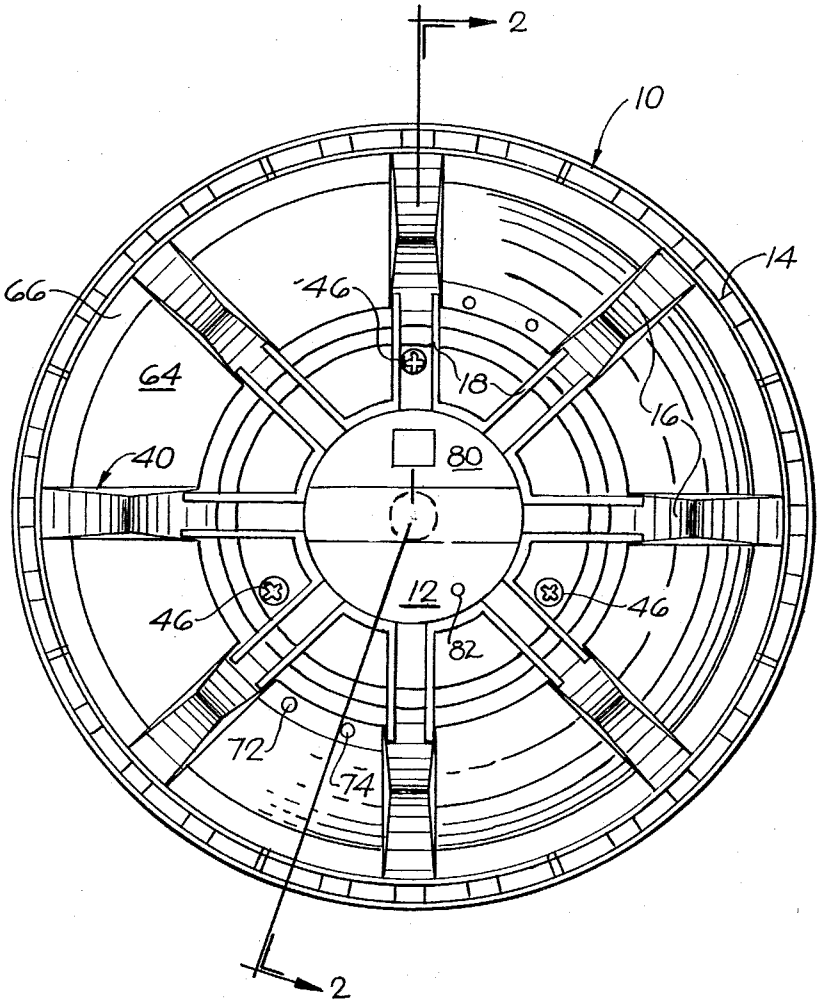
FIG. 1 is a rear elevational view of a loudspeaker constructed according to the teachings of the present invention.
Figure 4:
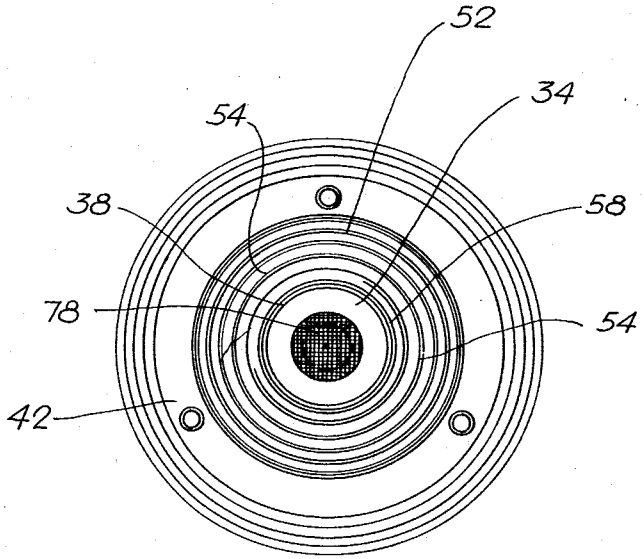
FIG. 4 is a sectional view of the loudspeaker taken along the line 4—4 of FIG. 2.
Figure 3:
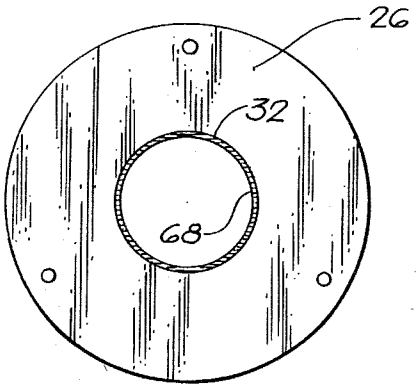
FIG. 3 is an elevational view of the front plate of the loudspeaker shown in FIG. 2.

FIG. 1 illustrates the frame 10 of the loudspeaker, and the frame 10 has a central pot 12 connected to a circular rim 14 by a plurality of spaced spokes 16. The pot 12 is provided with cooling fins 18.

The magnet structure 20 is mounted within the pot 12 and has a flat circular magnet 22 mounted between a flat circular back pole piece 24 and a flat circular front plate 26. The magnet 22, pole piece 24 and front plate are of ferromagnetic electrically conducting material. The back pole piece 24, magnet 22, and front plate 26 are provided with openings 28, 30 and 32 respectively, the openings being on a common axis centrally of the face plate 26. The surface of the opening 32 of the face plate 26 is cylindrical in shape. A hollow cylindrical post 34 is mounted on the pole piece 24 and extends coaxially within the opening 32, the inner channel of the post 34 being indicated at 36. The post 34 has an outer diameter smaller than the diameter of the opening 32 in the face plate 26 to form a cylindrical gap 38 between the post 34 and the face plate 26.

The magnet 22 has magnetic poles on opposite faces, and hence the magnetic circuit extends from the magnet 22 through the back pole piece 24, the ferromagnetic post 34, across the gap 38 and through the front plate 28. Since the cylindrical gap 38 limits the magnetic flux, the width of the gap should be as small as possible.

The rim 14 and spokes 16 of the frame 10 are part of a basket 40 which includes a ring 42 disposed at the ends of the spokes 16 opposite the rim 14. The ring 42 is flat on one side 44 and held into abutment with the surface of the face plate 26 by means of a plurality of bolts 46. The ring 42 has a second flat side 50 opposite the side 44, and a circular spider 52 is mounted at its periphery on the second flat side 50 of the ring 42. The spider 52 has a plurality of circular convolutions 54 and an inner circular aperture 56. The coil form 58 is mounted on the spider and carries a helically wound voice coil 60 of electrically conducting wire on its outer surface confronting the face plate 26, and the coil form 58 has a plurality of apertures 62 in the region thereof between the helical coil 60 and the spider 52. A diaphragm 64 in the form of a thin rigid cone has an outer perimeter mounted on the rim 14 through a compliant surround 66 and an inner perimeter mounted on the exterior surface of the coil form 58 adjacent to its end opposite the voice coil 60.

The voice coil 60 in the preferred embodiment is constructed of a flat strip of aluminum wire helically wound and cemented on the exterior surface of the coil form 58, the flat strip being provided with a coating of electrically insulating material, such as polyimide material or enamel.

The cylindrical surface of the opening 32 of the front plate is provided with a thin coating 68 of plastic. The coating 68 is preferably of a self-lubricating plastic such as Teflon, but may also be of nylon. In a preferred construction, the magnetic gap has a width of 0.059 inch, and a Teflon coating 68 is disposed upon the cylindrical surface of the opening 32 of the front plate 28 with a thickness of approximately 0.001 inch. It has been found that a Teflon coating of less than 0.0005 inch lacks the structural strength to remain in place throughout long periods of operation, and a coating of greater than 0.0015 inch unduly restricts the gap size for the voice coil 60. The voice coil 60 in the particular construction uses flat aluminum wire of No. 28 gauge and has a resistance of 5.2 ohms. The diameter of the opening 32 and the face plate 26 is approximately 2.57 inches and the face plate 26 has a thickness of approximately 0.43 inch. With this construction, an audio signal of 50 volts rms produces 400 watts of power in the voice coil and the voice coil will operate at a temperature as high as 500° F. The face plate 26 will operate at a temperature as high as 200° F. If adjacent turns of the voice coil should short, the power will increase. The coating 68 of plastic however prevents the momentary abutment of the voice coil 60 against the electrically conducting face plate 26 from resulting in an increase in power applied to the voice coil.

Heat from the magnetic structure is radiated to the atmosphere through the pot 12 and the fins 18. Heat from the voice coil 60 and coil form 58 is also conducted through the air which is free to circulate through the apertures 62, the gap 38, and the space formed between the post 34 and the magnet 22. In addition heat is carried by air circulation to the exterior of the magnetic structure 20 through the opening 28 in the pole piece 24 and the channel 36 in the post 34. The channel 36 is provided with screen 78 to prevent dust or other contamination from having access to the moving structure of the loudspeaker. A plate 80 is mounted on the pot 12 and provided with a plurality of ports 82 to allow air to circulate with respect to the interior of the magnetic structure. A dome 70 is mounted on the diaphragm 64 adjacent to the coil form 58, as by cement, and the dome forms an airtight seal with the diaphragm, thereby causing movement of the cone to further circulate the air with respect to the voice coil 60.

The voice coil 60 is connected to a pair of terminals 72 and 74 by wires 76 which pass through the diaphragm 64 to the interior of the coil form 68. The wires 76 are connected to opposite ends of the voice coil.

From the foregoing specification, those skilled in the art will devise many modifications and applications for the present invention. It is therefore intended that the scope of the present invention be not limited by the foregoing disclosure, but rather only by the appended claims.

The invention claimed is:

1. An electromagnetic loudspeaker comprising a frame, a magnetic structure mounted on the frame having a ferromagnetic plate with spaced parallel front and back surfaces, said plate having a cylindrical opening extending therethrough from the front to back surfaces thereof, and a ferromagnetic cylindrical center post of smaller diameter than the cylindrical opening disposed coaxially within the opening to form an annular gap between the center post and the plate, the magnetic structure producing a magnetic field with lines of force extending radially across the annular gap, a thin layer of Teflon disposed on and covering the entire surface of the cylindrical opening, a nonmagnetic electrically insulating cylindrical coil form having an inner diameter greater than the diameter of the cylindrical post and an outer diameter less than the diameter of the plastic coating on the cylindrical opening, means for mounting the cylindrical coil form to the frame for translation along its central axis, said mounting means suspending the cylindrical coil form coaxially with and confronting the cylindrical post, and a helical electrically conducting voice coil mounted on the outer surface of the cylindrical coil form and confronting the plastic coating on the opening in the plate.

2. An electromagnetic loudspeaker as claimed in claim 1 in combination with a generally conical diaphragm having a circular outer perimeter and a circular inner perimeter, the outer perimeter of said diaphragm being mounted on the frame and the inner perimeter of said diaphragm being mounted on the cylindrical coil form, the diaphragm being coaxial with the cylindrical coil form.

3. An electromagnetic loudspeaker as claimed in claim 2 wherein the means for mounting the cylindrical coil form on the frame comprises a circular generally flat spider having an outer perimeter mounted on the frame and an inner perimeter encompassing and mounted on the coil form between the voice coil and the diaphragm, said spider having a plurality of circular convolutions concentric with the perimeter and disposed between the inner and outer perimeters thereof in a plane generally normal to the axis of the cylindrical coil form.

4. An electromagnetic loudspeaker as claimed in claim 2 wherein the cylindrical gap has a width less than 0.06 inch and the Teflon layer has a thickness between 0.0005 inch and 0.0015 inch.

5. An electromagnetic loudspeaker as claimed in claim 4 wherein the voice coil comprises 28 gauge aluminum wire.

6. An electromagnetic loudspeaker comprising a frame, a magnetic structure mounted on the frame having a ferromagnetic plate with spaced parallel front and back surfaces, said plate having a cylindrical opening extending therethrough from the front to back surfaces thereof, and a ferromagnetic cylindrical center post of smaller diameter than the cylindrical opening disposed coaxially within the opening to form an annular gap between the center post and the plate, the magnetic structure producing a magnetic field with lines of force extending radially across the annular gap, a thin layer of nylon disposed on and covering the entire surface of the cylindrical opening, a nonmagnetic electrically insulating cylindrical coil form having an inner diameter greater than the diameter of the cylindrical post and an outer diameter less than the diameter of the plastic coating on the cylindrical opening, means for mounting the cylindrical coil form to the frame for translation along its central axis, said mounting means suspending the cylindrical coil form coaxially with and confronting the cylindrical post, and a helical electrically conducting voice coil mounted on the outer surface of the cylindrical coil form and confronting the plastic coating on the opening in the plate.

7. An electromagnetic loudspeaker as claimed in claim 6 wherein the cylindrical gap has a width less than 0.06 inch and the nylon layer has a thickness between 0.0005 inch and 0.0015 inch.

* * * * *